United States Patent [19]

Sittmann

[11] 3,964,757

[45] June 22, 1976

[54] HEEL HOLD-DOWN MECHANISM FOR SAFETY SKI BINDINGS

[75] Inventor: Brigitte Sittmann, Stuttgart, Germany

[73] Assignee: Vereinigte Baubeschlagfabriken Gretsch & Co. GmbH, Germany

[22] Filed: Aug. 8, 1974

[21] Appl. No.: 495,910

[30] Foreign Application Priority Data

Aug. 9, 1973 Germany ..... 2340416

[52] U.S. Cl. ..... 280/626; 280/634

[51] Int. Cl.² ..... A63C 9/08

[58] Field of Search ..... 280/11.35 T

[56] References Cited

UNITED STATES PATENTS

| | | | |
|---|---|---|---|
| 3,746,354 | 7/1973 | Nagasaki | 280/11.35 T |
| 3,773,341 | 11/1973 | Mimeur | 280/11.35 T |
| 3,778,073 | 12/1973 | Salomon | 280/11.35 T |
| 3,797,840 | 3/1974 | Unger | 280/11.35 T |

*Primary Examiner*—Robert R. Song

*Attorney, Agent, or Firm*—Craig & Antonelli

[57] ABSTRACT

A heel hold-down mechanism for safety ski bindings with a heel hold-down member carrying a spur and adapted to be pivoted up against the elastic detent effect by means of a movable detent member; the spur is thereby pivotally mounted at the heel hold-down member and is provided with a control surface cooperating with the detent member and extending transversely to the direction of movement of the detent member; the control surface is so arranged and constructed that the spur in the normal use position of the heel hold-down member is forced by the spring-loaded detent member in a holding-down sense against the heel hold-down member and after the heel hold-down member exceeds a predetermined upward stroke is so stressed by the detent member that it is pivoted underneath the heel.

28 Claims, 5 Drawing Figures

FIG.1
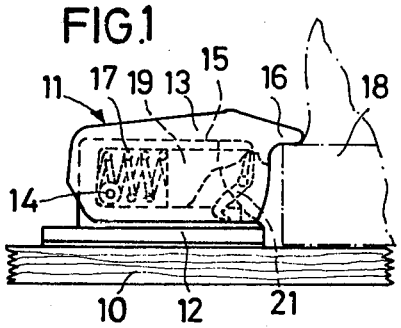
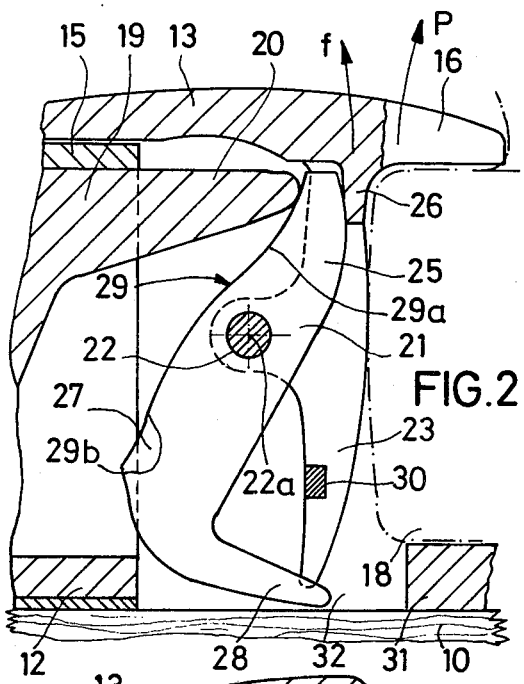
FIG.2
FIG.3
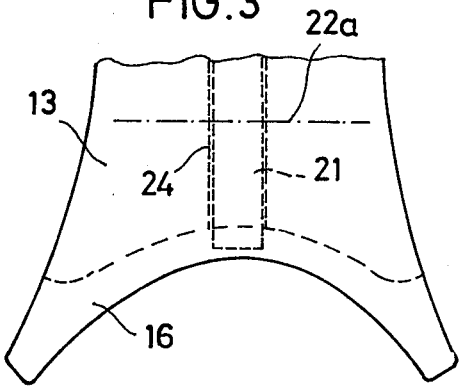
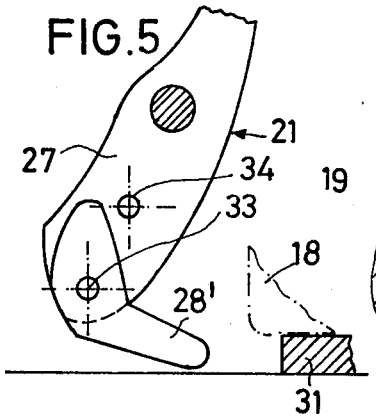
FIG.5
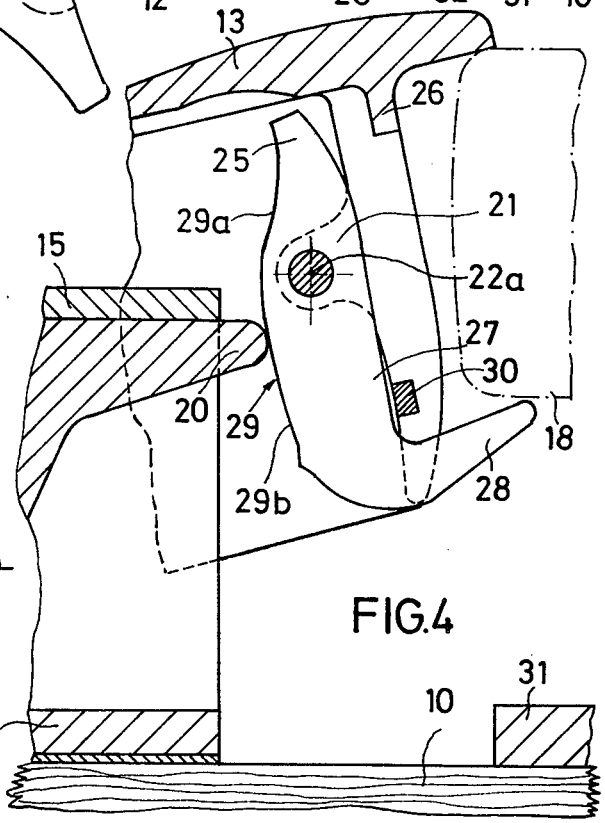
FIG.4

HEEL HOLD-DOWN MECHANISM FOR SAFETY SKI BINDINGS

The present invention relates to a heel hold-down mechanism for safety ski bindings with a heel hold-down member adapted to be pivoted up against an elastic detent effect by means of a movable detent member and carrying a step-in spur.

Known heel hold-down mechanisms of this type include a longitudinally displaceable piston slide member subjected to a spring action which is supported against a control cam at the heel hold-down member adapted to be pivoted up in such a manner that during the upward pivoting of the heel hold-down member the piston slide member within a first stroke portion is forced back against the spring action and within a further stroke portion slides along the control cam without longitudinal displacement. A spur is pivotally supported at the heel hold-down member, which is able to pivot freely within a limited pivoting range.

The present invention is concerned with the task to assure with simplest possible means a particularly reliable release of the boot in case of a fall and an effortless engagement of the binding, when stepping-in into the binding. Accordingly, the present invention essentially consists in that the spur is pivotally mounted at the heel hold-down member and is provided with a control cam extending transversely to the direction of movement of the detent member and cooperating with the latter, whereby the control cam is so arranged and constructed that the spur, in the normal use position of the heel hold-down member, is forced against the heel hold-down member by the detent member subjected to spring action in a holding-down sense and after exceeding a predetermined upward stroke of the heel hold-down member, is stressed or actuated by the detent member in such a manner that it is pivoted underneath the heel.

The spur thus has to fulfull two functions. On the one hand, it effects a sudden lifting moment at the boot as soon as, for example, as a result of a fall, the heel hold-down member has carried out a predetermined stroke; on the other hand, it has the effect to reliably bring about with slight friction a re-engagement of the hold-down mechanism under the pressure of the heel.

A construction is preferred such that after exceeding the predetermined upward stroke, the detent member also exerts a lifting moment on the heel hold-down member. Preferably, the detent member thereby rolls off along the control cam. The frictional resistance against release of the binding is reduced thereby. Preferably the spur is constructed as a two-armed lever pivotally mounted at the heel hold-down member about a transversely extending pivot axis parallel to the ski surface, with a control cam surface extending over both lever arms, whereby the pivot axis of the spur is so arranged in relation to the longitudinally displaceable detent member, for example, to the piston slide-like detent member that the detent member in the engaged position of the heel hold-down member engages at the control cam portion of the upwardly directed lever arm and after the heel hold-down member has exceeded a predetermined upward stroke during which it passes through a dead center position in relation to the detent spring, engages at the control cam portion of the downwardly directed lever arm.

Advantageously, the spur abuts with its upper lever arm at an abutment in the normal use position. In this manner the spur, up to the point of passing through the dead center position, behaves like a control cam portion rigidly connected with the heel hold-down member.

Advantageously, the spur includes at the bottom an approximately rectangularly bent off spur element which in the normal use position is disposed to the rear and below the boot heel. It is assured in this manner that in the case of the release the spur is in operative engagement with the boot heel in a safe and effective manner. In the normal use position, in contradistinction thereto, the heel rests exclusively on the base plate whereas the spur and in particular the spur element is retracted completely into the heel hold-down member.

It is thereby particularly advantageous if the spur element is pivotally mounted at the lower lever arm whereby its downward pivot movement is limited by an abutment. The pivot range of the spur is reduced thereby because the spur element is able to tilt inwardly as needed, during the release or engagement.

These and further objects, features and advantages of the present invention will become more apparent from the following description when taken in connection with the accompanying drawing which shows, for purposes of illustration only, two embodiments in accordance with the present invention and wherein:

FIG. 1 is a schematic side elevational view of a heel hold-down mechanism according to the present invention;

FIG. 2 is a partial longitudinal cross-sectional view, on an enlarged scale, through the forward portion of the heel hold-down mechanism in accordance with the present invention in the engaged or locked position thereof;

FIG. 3 is a partial plan view on FIG. 1;

FIG. 4 is a partial longitudinal cross-sectional view, similar to FIG. 2, however illustrating the various parts when the heel hold-down member is pivoted up; and FIG. 5 is a partial somewhat schematic side elevational view of a modified embodiment of the step-in spur in accordance with the present invention of the heel holding mechanism illustrated in the preceding figures.

Referring now to the drawing wherein like reference numerals are used throughout the various views to designate like parts, the heel retaining or hold-down mechanism generally designated by reference numeral 11 is mounted on the ski 10 in any suitable manner, for example, under interposition of a base plate 12 permitting an adjustment in the ski longitudinal direction. The heel hold-down mechanism 11 includes a heel hold-down member 13 which is supported at a housing-shaped bearing support structure 15 secured on the base plate 12 for upward pivotal movement thereof, for example, about a rear horizontal cross axis 14, under the effect of a detent spring 17 forces the boot heel 18 against the ski by means of a forward hold-down element 16.

The detent spring 17 is arranged on the inside of the housing-shaped bearing support structure 15 and acts on a piston-slide-like detent member 19, for example, in the form of a piston slide member, displaceable in the ski longitudinal direction within this housing, which includes in its upper portion a forwardly directed projection 20. This projection 20 abuts under the effect of the spring 17 against a step-in spur 21 constructed as two-armed lever which is pivotally supported by means of a pin 22 about a cross axis 22*a* at a forward wall portion 23 of the heel hold-down member 13 adapted to be pivoted up within a slot 24 thereof and under the effect of the detent spring 17 and of the piston slide member 19 spring loaded by the spring 17, is being forced with its upper lever arm 25 against an abutment 26 provided at the heel hold-down member 13. Its further lower lever arm 27 is bent off into a forwardly directed end portion 28 which serves as stepin spur element, properly speaking. On its side facing the piston slide member 19 the spur 21 is provided with a control cam surface generally designated by reference numeral 29 which includes an upper cam section 29*a* above the pivot axis 22*a* and a lower cam section 29*b* below the pivot axis 22*a*.

In FIG. 2 the heel hold-down mechanism is illustrated in its normal use position when the binding is engaged, i.e., the boot is held onto the ski. The detent spring 17 exerts a pressing-down moment on the heel hold-down member 13 by way of the piston slide member 19 and by way of the liner arm 25 of the spur 21, whereby the hold-down element 16 of the heel hold-down mechanism 13 presses the boot heel 18 in the downward direction. The spur element 28 is thereby disposed to the rear and below the boot heel. The heel support plate 31 is thereby constructed of such height that a sufficient pivot space 32 remains therebehind for the spur element 28.

If, for example, as a result of a forward fall, a strong upwardly directed force occurs in the direction of arrow P (FIG. 2), then together with the heel hold-down member 13 also the spur 21 is pivoted up in the direction of arrow *f* about the shaft 14, whereby the piston slide member 19 by means of its projection 20 slides along the rear edge of the spur 21 acting as control cam 29 and is thereby forced back against the action of the detent spring 17.

As long as the force direction of the piston slide member 19 by means of its projection 20 still lies above the axis 22*a* of the bearing pin 22 of the spur 21, a holding-down moment (opposite the direction of arrow *f*) is exerted on the heel hold-down member 13 by way of the spur 21. However, as soon as the pressure force line of the piston slide member 19 has dropped below the axis 22*a* in its movement in the downward direction, i.e., has passed through a dead center position with respect to the spur 21, in that the projection 20 of the piston slide member 19 has slid from the upper section 29*a* of the detent curve 29 onto the lower section 29*b* thereof, a torque is exerted on the spur 21 by the piston slide member 19 which pivots the spur 21 about the axis 22*a* thereof in the counter-clockwise direction, as viewed in the drawing, and simultaneously exerts a lifting moment on the heel holddown member 13 by way of the bearing pin 22. It is thereby of advantage that the sliding movement of the projection 20 along the detent cam surface 29 passes over increasingly into a rolling off action within the release range; the disengagement of the heel hold-down member 13 is facilitated thereby. The lower lever arm 27 of the spur 21 together with the spur element 28 pivots forwardly underneath the heel 18 of the boot which lifts off from the ski, until the spur 21 comes into abutment at the heel hold-down member 13, for example, at an abutment member 30 while the boot heel continues to lift off.

If the ski is to be connected again with the boot, then the skier steps with the heel on the forwardly projecting step-in spur element 28 whereby the heel hold-down member 13 is again forced downwardly with the assistance of the detent spring 17. The step-in spur 21 is thereby at first continued to be forced forwardly by the detent spring 17 until again the dead center postion is being passed through by the piston projection 20 at the height of the axis 22*a* of the spur 21, whereupon the spur 21 again pivots back in the clockwise direction out of the position according to FIG. 4 into the position according to FIG. 2. Simultaneously, a downward pressing moment is exerted on the heel hold-down member 13 and therewith the position according to FIG. 2 is again reached force-lockingly. The spur element 28 is therefore pivoted away from the heel at the instant when it is no longer needed because the spring 17 takes over the further downward movement of the hold-down member 13. On the other hand, up to this instant, the forcing back action of the piston slide member 19 is favored by pivotal mounting of the step-in spur 21 since in particular the friction conditions are more favorable.

A further advantageous development is illustrated in FIG. 5. In this embodiment the step-in spur element 28' is pivotally mounted at the step-in spur 21 about a cross axis 33. The pivot range of the spur 21 is reduced in this manner so that the base plate 31 can be constructed lower. An abutment 34 limits the pivot movement of the spur element 28' in the downward direction. During abutment at the stop 34 the spur element 28 is disposed approximately perpendicularly to the lever arm 27.

While I have shown and described two embodiments in accordance with the present invention, it is understood that the same is not limited thereto but is susceptible to numerous changes and modifications as known to those skilled in the art and I therefore do not wish to be limited to the details shown and described herein but intend to cover all such changes and modifications as are encompassed by the scope of the appended claims.

I claim:

1. A heel hold-down mechanism for safety ski bindings comprising:

housing means, heel hold-down means supported for movement with respect to said housing means between a heel hold-down position in engagement with a ski boot heel and a heel release position, resiliently biased movable detent means guided at said housing means for movement along a predetermined path, and spur means in the form of a lever pivotally supported at said heel hold-down means, said spur means including a spur element engageable with a ski boot heel during placement of a ski boot thereon with said heel hold-down means in said heel release position, wherein said detent means is engageable with a cam surface of said spur means to effect transfer of forces and movement between said housing means and said heel hold-down means.

2. A heel hold-down means according to claim 1, wherein said cam surface and said detent means are configured such that movement of said heel hold-down means a predetermined distance from its heel hold-down position towards its maximum heel release position results in a pivoting of said spur means with said spur element moving a position corresponding to engagement with the underside of a ski boot heel being engaged by said heel hold-down means.

3. A heel hold-down means according to claim 2, wherein said cam surface and said detent means are configured such that said movement of a predetermined distance by said heel hold-down means results in said detent means exerting a lifting moment on the heel hold-down means.

4. A heel hold-down means according to claim 3, wherein said detent means is spring biased against said cam surface at all times.

5. A heel hold-down mechanism according to claim 4, characterized in that the detent means cooperating with the cam surface is operable to run off along the cam surface in such a manner that within the range of the release of the binding, with a lifting-up of the hold-down means, the detent means carries out a roll-off movement along the cam surface.

6. A heel hold-down mechanism according to claim 5, characterized in that the spur means in constructed as two-armed lever having its cam surface extending over both lever arms, said two-armed lever being pivotally mounted at the heel hold-down means about a transversely extending pivot axis disposed substantially parallel to the ski surface, the pivot axis of the spur means being so arranged in relation to the longitudinally displaceable detent means that the detent means, in the heel hold-down position of the heel hold-down means, engages at the cam surface portion of the upwardly directed lever arm and after the hold-down means exceeds a predetermined upward stroke passing through a dead center position in relation to the detent spring, engages at the cam surface portion of the downwardly directed lever arm.

7. A heel hold-down mechanism according to claim 6, characterized in that the detent means is a piston slide-like detent member.

8. A heel hold-down mechanism according to claim 6, characterized in that the spur means is supported in a substantially central vertical longitudinal slot of the heel hold-down means and engages into an aperture of the piston slide-like detent means slidably supported in a relatively fixed slide track.

9. A heel hold-down mechanism according to claim 8, characterized in that the relatively fixed slide track is formed by the housing means.

10. A heel hold-down mechanism according to claim 8, characterized in that the spur means abuts with its upper lever arm at a stop in the normal heel hold-down position of the heel hold-down means.

11. A heel hold-down mechanism according to claim 10, characterized in that the spur element is constructed as an approximately rectangularly bent off spur element at the lower portion of the spur means which in the heel hold-down position of the heel hold-down means is disposed to the rear and below a boot heel of a ski boot engaged by said heel hold-down means.

12. A heel hold-down mechanism according to claim 10, characterized in that the spur element is pivotally mounted at the lower lever arm, the upward movement of the spur element being limited by an abutment.

13. A heel hold-down mechanism according to claim 12, characterized in that the abutment is provided at the heel hold-down means.

14. A heel hold-down mechanism according to claim 10, characterized in that the spur means is a step-in spur, against which one steps with the boot heel when engaging the ski binding.

15. A heel hold-down mechanism according to claim 1, characterized in that the spur means is constructed as a two-armed lever having its cam surface extending over both lever arms, said two-armed lever being pivotally mounted at the heel hold-down means about a transversely extending pivot axis disposed substantially parallel to the ski surface, the pivot axis of the spur means being so arranged in relation to the longitudinally displaceable detent means that the detent means in the heel hold-down position of the heel hold-down means, engages at the cam surface portion of the upwardly directed lever arm and after the hold-down means exceeds a predetermined upward stroke passing through a dead center position in relation to a detent spring biasing the detent means, engages at the control surface portion of the downwardly directed lever arm.

16. A heel hold-down mechanism according to claim 15, characterized in that the detent means is a piston slide-like detent member.

17. A heel hold-down mechanism for safety ski bindings comprising:

relatively fixed housing means, heal hold-down means supported for movement with respect to said housing means between a heel hold-down position in engagement with a ski boot heel release position, resiliently biased movable detent means guided on said housing means for movement along a predetermined path, and spur means in the form of a lever pivotally supported at said heel hold-down means, said spur means including a spur element engageable with a ski boot heel during placement of a ski boot thereon with said heel hold-down means in said heel release position, wherein said spur means in configured such that said spur element is pivotally moved away from engagement with said ski boot heel when said heel hold-down means is moved to said heel hold-down position in engagement with a ski boot heel and wherein said detent means is engageable with a cam surface of said spur means to effect transfer of forces and movement between said housing means and said heel hold-down means.

18. A heel hold-down mechanism according to claim 17, wherein said spur means is in the form of a rigid two armed lever having said cam surface in constant engagement with said movable detent means, said spur element being at one end of said lever.

19. A heel hold-down mechanism according to claim 18, characterized in that the detent means cooperating with the cam surface is operable to run off along the cam surface in such a manner that within the range of the release of the binding, with a lifting-up of the hold-down means, the detent means carries out a roll-off movement along the cam surface.

20. A heel hold-down mechanism according to claim 18, characterized in that the spur means abuts with its upper lever arm at a stop in the normal heel hold-down position of the hold-down means.

21. A heel hold-down mechanism according to claim 18, characterized in that the spur means includes an approximately rectangularly bent off spur element at a lower portion thereof which in the heel hold-down position of the heel hold-down means is disposed to the rear and below a boot heel of a boot engaged by the mechanism.

22. A heel hold-down mechanism according to claim 18, characterized in that the spur element is pivotally mounted at a lower lever arm of the spur means, the upward movement of the spur element being limited by an abutment.

23. A heel hold-down mechanism according to claim 22, characterized in that the abutment is provided at the heel hold-down means.

24. A heel hold-down mechanism according to claim 17, characterized in that the detent means is a piston slide-like detent means slidably supported in a relatively fixed slide track, and characterized in that the spur means is supported in a substantially central vertical longitudinal slot of the heel hold-down means.

25. A heel hold-down mechanism according to claim 24, characterized in that the relatively fixed slide track is formed by said housing means.

26. A heel hold-down mechanism according to claim 17, characterized in that the spur means is a step-in spur, against which one steps with the boot heel when engaging the ski binding.

27. A heel hold-down mechanism according to claim 17, wherein said spur means is pivotally carried by said heel hold-down means at a pivot pin carried by said heel hold-down means, wherein said movable detent means engages said cam surface at one side of said pivot pin when said heel hold-down means is in said heel hold-down position and engages said cam surface at the other side of said pivot pin when said heel hold-down means is in said heel release position, and wherein said spur element is at the end of said spur means on said other side of said pivot pin, whereby pivoting of said spur means about said pivot pin takes place as said detent means moves from one side thereof to the other.

28. A heel hold-down means according to claim 27, wherein said movable detent means is spring loaded and guided for linear movement in said fixed housing which also supports a fixed pivot axis for said heel hold-down means.

* * * * *